US006352748B1

(12) United States Patent
Aylward et al.

(10) Patent No.: US 6,352,748 B1
(45) Date of Patent: Mar. 5, 2002

(54) IMAGING ELEMENT INCLUDING BRACE AND MECHANICAL HOLDING MEANS

(75) Inventors: Peter T. Aylward, Hilton; Robert P. Bourdelais, Pittsford; Alphonse D. Camp, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/533,640

(22) Filed: Mar. 22, 2000

(51) Int. Cl.[7] ..... A47F 1/12

(52) U.S. Cl. ..... 428/14; 428/13; 428/121; 428/195; 428/327; 428/483; 428/500; 428/913

(58) Field of Search ..... 428/206, 195, 428/211, 483, 913, 198, 172, 500, 13, 14, 327, 212; 430/201

(56) References Cited

U.S. PATENT DOCUMENTS

| | | | | |
|---|---|---|---|---|
| 3,885,080 | A | 5/1975 | Lambert et al. | 428/336 |
| 4,244,762 | A | 1/1981 | Holson | 156/73.1 |
| 4,263,357 | A | 4/1981 | Holson | 428/138 |
| 4,355,099 | A | 10/1982 | Trautweiler | 430/531 |
| 5,225,319 | A | 7/1993 | Fukazawa et al. | 430/533 |
| 5,663,023 | A | 9/1997 | Malhotra | |
| 5,763,128 | A | 6/1998 | Malhotra | |
| 5,866,282 | A | 2/1999 | Bourdelais et al. | 430/22 |
| 6,022,679 | A | 2/2000 | Kawamoto | |
| 6,045,965 | A | 4/2000 | Cournoyer et al. | 430/263 |
| 6,056,494 | A | 5/2000 | Fong et al. | 412/37 |
| 6,080,532 | A | 6/2000 | Camp et al. | 430/363 |

FOREIGN PATENT DOCUMENTS

| | | |
|---|---|---|
| WO | WO 90/00760 | 1/1990 |

*Primary Examiner*—Deborah Jones
*Assistant Examiner*—Abraham Bahta
(74) *Attorney, Agent, or Firm*—Paul A. Leipold

(57) ABSTRACT

The invention relates to a mechanically assembled picture comprising at least one image element comprising an image on a thin polymer sheet, a brace, and a transparent polymer sheet overlaying said image and brace, wherein said transparent sheet mechanically holds said image to said brace.

26 Claims, 1 Drawing Sheet

IMAGING ELEMENT INCLUDING BRACE AND MECHANICAL HOLDING MEANS

FIELD OF THE INVENTION

This invention relates to photographic materials. It particularly relates to photographic base materials and the formation of a mechanically assembled picture utilizing a brace.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult requiring great care and expense to ensure proper laydown and cooling of the polyethylene layers. Such a smooth surface requires a great deal of care and expense associated with chill rolls. There is a need for a photographic color print material that has a polyethylene surface but does not require chill rolls for the formation of a glossy surface.

In photographic papers the polyethylene layer also serves as a carrier layer for titanium dioxide and other whitener materials as well as tint materials. It would be desirable if the colorant materials rather than being dispersed throughout the polyethylene layer could be concentrated nearer the surface of the layer where they would be more effective photographically.

In the formation of photographic and other imaging elements it is known in the art to coat or apply layers of polymer to or to laminate biaxially oriented sheets of polymer to a base substrate such as paper or polyester. It is further known in the art as disclosed in U.S. Pat. No. 4,355,099 to provide a silver halide layer on a clear film, expose, develop, process and then to post laminate using an adhesive to a light reflective base. While such a composite structure has a number of advantages, it is very difficult and cumbersome to apply an adhesive, cure it and then stick two webs together. There remains a need to provide an imaging element with a thin protective polymer sheet with an image receiving layer that can be attached to a reflective base without the use of expensive, messy adhesive.

In U.S. Pat. No. 5,663,023 a two part system for xerography and ink is disclosed. The first part provides a clear substrate with a reverse reading image that is imaged and then joined with a reflective base that has been pre coated with an adhesive. While this technique overcomes some of the difficulties of applying an adhesive at the time of image formation by using a pre-coated substrate, there are additional problems and difficulties with joining the two substrates without creases. Furthermore even pre-coated adhesives a still messy and may contaminate the work area and render the image useless because of the contamination problems. There remains a need to provide an imaging element with thin clear polymer over the image that can be attached to a reflective or even transparent base without the use of expensive, messy adhesives.

In U.S. Pat. No. 5,866,282 it is proposed to attach sheets of biaxially oriented polymer to a base substrate for photographic use, and in U.S. Pat. No. 5,888,714 it is proposed to use an adhesive such as metallocene catalyzed ethylene plastomers for bonding biaxially oriented polyolefin sheets. Both these inventions provide excellent print materials and are able to adhere the biaxially oriented sheets to the base substrate. The base substrate provides sufficient stiffness to the support for conveyance through the various coating and processing machines. One drawback of this system is the expense of having to adhere polymer sheets to a base substrate and then carry the added weight and thickness throughout the manufacturing and photofinishing process. The added thickness put limitations on the length of rolls requires frequent roll changes, which results in added waste and expense. There remains a need to provide a substantially thin imaging support that does not require it to be adhered to a thick base substrate.

Photographic materials have been known for use as prints for preserving memories for special events such as birthdays and vacations. They also have been utilized for large display materials utilized in advertising. These materials have been known as high quality products that are costly and somewhat delicate, as they would be easily defaced by abrasion, water, or bending. Photographs are traditionally placed in frames and photo albums in view of their fragile and delicate nature, as well as their value. They are considered luxury items for the consumers to preserve a record of important events in their lives. Photo albums and picture frames do not allow prints to be handled and viewed in a convenient or friendly manner. There remains a need to provide a convenient and friendly format for images to be shared with a number of people without fear of irreversible damage.

Prior art photographic reflective materials typically contain cellulose fiber paper to provide support for the imaging layers. While paper is an acceptable support for the imaging layers, providing a perceptually preferred feel and look to the photograph, paper does present a number of manufacturing problems which reduce the efficiency at which photographic paper can be manufactured. Problems include those such as processing chemistry penetration into the edges of the paper, paper dust as photographic paper is slit, punched and chopped, and as loss of emulsion hardening efficiency because of the moisture gradient that exists between the photographic emulsion and the paper. It would be desirable if a reflective image could be formed without the use of cellulose paper.

In reflective photographic papers there is a need to protect the imaging layers from scratches, fingerprints, and stains. Current photographic reflective papers use a gelatin overcoat to protect the imaging layers. While the gelatin does provide some level of protection, it can easily be scratched reducing the quality of the image. Further, fingerprints or stains caused by common household liquids such as coffee, water, or fruit juice can easily stain and distort images. Wiping the images while wet causes undesirable distortion to the gelatin overcoat. Post photographic processing equipment exists that provides a protective coating to the imaging layers. Typically consumer images are individually coated or laminated with a polymer to provide protection to the image layers. A common example is photographic identification badges that are typically laminated with a clear polymer sheet to provide protection to the image on the identification badge. Post processing application of a protective layer is expensive, as it requires an additional step in the preparation of the reflective print and additional materials to provide the overcoat. It would be desirable if a reflective photographic image could be formed with a protective coating over the developed image layers that could be efficiently applied.

Typically, photographic reflective imaging layers are coated on a polyethylene coated cellulose paper. While polyethylene coated cellulose paper does provide an acceptable support for the imaging layers, there is a need for alternate support materials such as polyester or fabric. The problem with alternate, nonpaper supports is the lack of robustness in photographic processing equipment to mechanical property changes in supports. The photographic processing equipment will not run photographic materials that have significantly different mechanical properties than prior art photographic materials. It would be desirable if a reflective photographic image could be efficiently formed on alternate supports.

In the consumer industry materials are placed in packages as a means of protection or preserving the quality of the delicate products. Photographs and images are a very delicate product but are not traditional protected from handling damage, spills, fingerprints and other abuses. In some application the image may be overlaminated with a clear polymer sheet, but once again, the overlaminate sheet must be adhesive coated prior to application to the image. These overlaminates create problems with curl and torsional strain on the image structure that render them undesirable. There remains a need to provide a print with protection without curl and other problems.

PROBLEM TO BE SOLVED BY THE INVENTION

Photographic images are typically produced on a thick polymer coated paper base. The paper base used for photographic prints is very expensive and must be very pure and free of materials that are photoactive and resistant to photo processing chemicals. There remains a need for a photographic print material that is not limited by these and other design limitations.

SUMMARY OF THE INVENTION

It is an object of the invention to provide improved imaging elements.

It is another object to provide an imaging element that does not need to be adhered to a thick base.

It is a further object to provide images that are not easily damaged.

It is an additional object of this invention to provide an image that is sealed from the environment.

These and other objects of the invention are accomplished by a mechanically assembled picture comprising at least one image element comprising an image on a thin polymer sheet, a brace, and a transparent polymer sheet overlaying said image and brace, wherein said transparent sheet mechanically holds said image to said brace.

ADVANTAGEOUS EFFECT OF THE INVENTION

The invention provides improved image protection. The invention includes a means to join a base substrate to an image without environmental protection without the use of expensive and messy adhesives. This invention provides an imaging element with a brace that makes a pleasing image for the consumer.

DETAILED DESCRIPTION OF THE INVENTION

Figure 1:
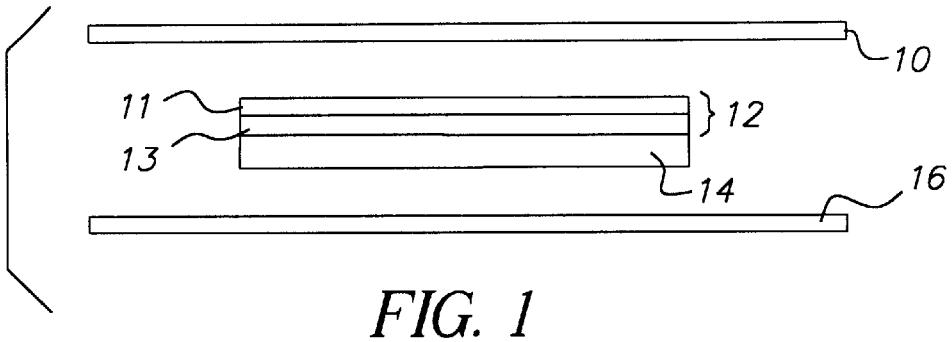
FIG. 1 is a schematic of the unassembled imaging member of the invention.

The invention has numerous advantages over prior practices in the art. Current imaging elements have a light sensitive silver halide layer, or a dye receiving layer for ink jet or thermal imaging applications or perhaps have toner deposited on a surface to form an image or text. All these elements typically consist of a surface layer with a more substantial base that provides support to the image. Typically the bases are white, reflective and thick, or in some cases transparent. Whatever the configuration they have a substantially thick support that is a critical part of the imaging element for handling and feel. Furthermore the base is the platform that supports the image. The imaging element of this invention may have either a thin reflective imaging carrying layer or a thin transparent image carrying layer. Since the carrying layer may be a thin polymer sheet, larger rolls of material may be used throughout the manufacturing operations as well as in photofinishing or printing. Larger rolls are important in minimizing cost associated with roll to roll transfers that create waste on each roll change. Smaller rolls also result in more frequent changes, which consume operator time.

The utilization of the thin, flexible, and tough silver halide materials results in an imaging element having many superior properties. These elements are bright, sharp, and high in color as well as having resistance to abrasions, spills, scratches, fingerprints and other handling related damage. The imaging elements of this invention have a depth of image unsurpassed by existing materials. The imaging elements of the invention while having the advantage of superior image are available on thin base materials that are low in cost while providing superior opacity and strength.

The terms as used herein, "top", "upper", "emulsion side", and "face" mean the side or toward the side of a photographic packaging label bearing the imaging layers. The term environmental protection layer means the layer applied to the post processed imaging layers. The terms "face stock" and "substrate" mean the material to which the silver halide layers are applied. The terms "bottom", "lower side", "liner" and "back" mean the side or toward the side of the photographic label or photographic packaging material opposite from the side bearing the photosensitive imaging layers or developed image. The term "brace" refers to stiffening material that is brought into contact with the imaged thin polymer sheet. The brace provides an important function. It provides substantial thickness and stiffness to a thin imaged polymer sheet and provides the viewer with a comfortable tactile feel when handling the imaged print. In general it is used to support the image and the carrying polymer layer. Typical brace materials may be paper, cardboard, foam backing board, wood, metal, metallized substrates, textile, cloth, other plastics. They may be substantially opaque or transparent and may either be smooth or rough. The brace material may also be any shape because the imaged transparent polymer sheet may be made to conform to most any shape or physical configuration and is held mechanically to the brace by a transparent sheet. The term picture refers to an image or text and image. The image may be made with photosensitive silver halide, photographic dyes, ink jet, thermal dye sublimation or electrophotographic.

Figure 2:
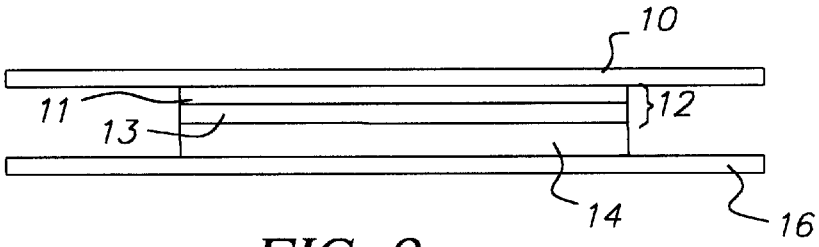
FIG. 2, FIG. 3, and FIG. 4 illustrate the assembly and sealing of the imaging element of the invention.

The imaging element of this invention has the ability to be joined with any substrate without regard to having an adhesive to hold the image in contact with the supporting member. FIGS. 1–4 show the basic steps to incorporate a picture in a sealed package without the use of adhesives. FIG. 1 illustrates the individual components needed for a mechanically assembled picture. The transparent polymer sheet 10 of said invention which overlays the said imaging element 12 on the topside and by transparent sheet 16 which overlays the brace 14 from the bottom side. It is below the brace. The imaging element 12 comprises the image layer 11 and a base thin polymer sheet 13. FIG. 2 is a representation of the individual components having been placed together and not held together other than by their own weight. The transparent polymer sheet 10 is physically touching the imaging element 12 which is physical touching the brace 14 which is physically touching the bottom transparent polymer sheet 16. It should be noted in FIG. 2 that the transparent polymer sheets 10 and 16 extend beyond the edges of the imaging element 12 and the brace 14.

Figure 3:
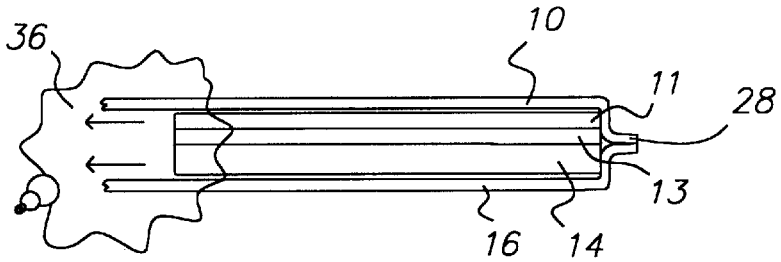
Figure 4:
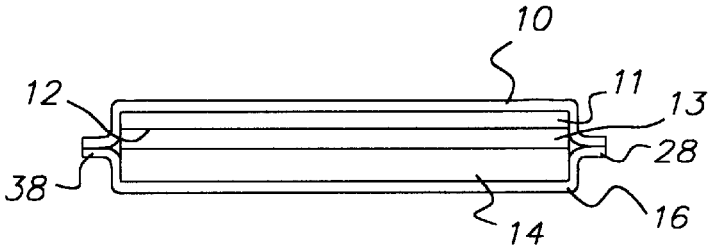

In FIG. 3 one edge of the top and bottom transparent polymer sheets 10 and 16 is brought together and sealed 28 over the edge of the imaging element 12 and the brace 14 while a vacuum 36 is applied. The vacuum helps to pull the air out of the package and between the layers so that there is intimate contact between the layers. FIG. 4 is the completed mechanically assembled picture wherein transparent polymer sheets 10 and 16 have been sealed on each edge 28 and 38. Having been vacuum evacuated and sealed, the transparent polymer sheet and 16 holds the imaging element 12 to the brace 14.

The supporting brace is brought into contact with the thin imaged polymer sheet, cut and then mechanically assembled and held in place using a transparent sheet. The actual cutting of the thin polymer sheet and brace may be done simultaneously, in which the brace provides substantial support during the cutting/chopping action. The cutting and chopping of the brace and thin imaged polymer sheet may also be done in separate steps and then the two cut parts are then brought into the proper configuration and a thin transparent sheet is applied to mechanically hold the parts together. In this manner the assembled picture is mechanically held together without the need for expensive, messy adhesives. Adhesives are not preferred because they yellow with time and are not stable to ultraviolet light over time. Some adhesives are not fully cured or cross-linked resulting in dimensional changes and chemical out gassing. Some of these gases may interact with the imaging dyes or silver in the case of black and white photographs and result in their degradation.

A preferred embodiment of this invention is a mechanically assembled picture that has an image on a thin polymer sheet, a brace and a transparent polymer sheet overlaying the brace and the imaged thin polymer sheet. The overlaying transparent polymer sheet mechanically holds the image to the brace. In an additional embodiment the overlaying transparent polymer sheet covers both the top and bottom surfaces and edges of said assembled picture. The transparent polymer sheet is shrunk to mechanically hold the image and brace.

An additional embodiment of this invention provides a polymer sheet bag that is sealed to mechanically hold the image and brace. In a further embodiment a vacuum is applied to the bag prior to sealing. The vacuum helps to assure that there is good optical contact between the imaged polymer sheet and brace. Since there may be some remaining gases inside the sealed bag, the bag containing the imaged polymer sheet and brace may be purged with an inert gas prior to having the vacuum applied. In the case of some brace material such as paper, textiles or cardboard any air pockets in the brace are filled with the inert gas. This is important when the image dyes, pigments and other chemistry in the imaging layer is sensitive to oxygen. The inert gases may either be pure gases or mixtures of gases such as nitrogen, argon, helium, carbon dioxide or other suitable gas. The mechanically assembled picture may use a transparent bag that is sealed and shrunk after drawing a vacuum.

The transparent polymer sheet of this invention preferably has an oxygen transmission rate of less than 8.0 cc/m$^{2\cdot}$ hr. atm. oxygen transmission rate. This may be achieved by the polymer selection or by a layer on the top or bottom side of said transparent polymer sheet or may be an integral part of the transparent polymer. Said oxygen barrier may be selected from the group consisting of an oxygen barrier layer having less than 8.0 cc/m$^2$ hr. atm. oxygen transmission rate. The oxygen barrier may be incorporated as a layer into the said transparent polymer sheet that overlays the image and brace through co-extrusion prior to biaxial orientation. Said oxygen impermeable layer comprises at least one member selected from the group consisting of homo- and co-polymers of acrylonitrile, alkyl acrylates such as methyl acrylate, ethyl acrylate, butyl acrylate, alkyl methacrylates such as ethyl methacrylate and methyl methacrylate, methacrylonitrile, alkyl vinyl esters such as vinyl acetate, vinyl propionate, vinyl ethyl butyrate and vinyl phenyl acetate, alkyl vinyl ethers such as methyl vinyl ether, butyl vinyl ether, chloroethyl vinyl ether, vinyl alcohol, vinyl chloride, vinylidene chloride, vinyl fluoride, styrene and vinyl acetate (in the case of copolymers, ethylene and/or propylene can be used as comonomers), cellulose acetates such as diacetyl cellulose and triacetyl cellulose, polyesters such as polyethylene terephthalate, a fluorine resin, polyamide (nylon), polycarbonate, polysaccharide, aliphatic polyketone, blue dextran, and cellophane. The said oxygen barrier layer would preferably be located in the sheet structure at the interface between the said transparent polymer sheet and the image layers on the top side and the brace on the bottom side. This location would have minimal effect on the overall image quality while positively impacting image stability. Two preferred barrier layer materials for this structure are 1) an aliphatic polyketone polymer and 2) a copolymer of vinyl alcohol and ethylene whereby the second is most preferred because they are low in cost and effective oxygen barriers. These materials possess very low oxygen transmission rates and can be extruded through multilayer coextrusion equipment with minimal modifications to the process. The thickness of the oxygen barrier layer of this invention is not critical, provided that the oxygen permeability is not more than 8.0 cc/m$^{2\cdot}$ hr. atm. oxygen transmission rate, and more preferably not more than 2.0 m$^{2\cdot}$ hr. atm. oxygen transmission rate, as this level appears to provide a good balance between material cost and benefits of use. The preferred barrier layer material is a copolymer of vinyl alcohol and ethylene and is incorporated into the transparent polymer sheet prior to orientation through coextrusion. A second method of incorporating an oxygen barrier layer having less than 8.0 cc/m$^{2\cdot}$ hr. atm. oxygen transmission rate is to apply the layer as a post extrusion coated layer onto the said transparent sheet. This post extrusion layer comprises at least one member selected from the group consisting of polyvinyl alcohols, polyvinylidene chlorides, aliphatic polyketones, chemically hardened gelatin, and mixtures thereof. Liquid coating methods which can be used according to the invention include a method in which a polymer is dissolved in water or an organic solvent, uniformly coated on the transparent polymer sheet, and dried by hot air, and a method in which a polymer emulsion is coated and then dried. These application techniques are generally known in the industry. In the preferred form, the post extrusion layer comprises a layer of polyvinyl alcohol, which is applied to the sheet as an aqueous coating. Aqueous coated polyvinyl alcohol has a very low oxygen transmission rate and can be produced to have no detrimental effect on silver halide imaging technology.

The control of water vapor transmission can be provided by the transparent polymer sheet or the imaged thin polymer sheet. In the preferred embodiment the transparent sheet of the mechanically assembled picture has a water vapor transmission rate of less than $0.85\times10^{-5}$ g/mm$^2$/day. With the incorporation of other layer(s) that are integrally formed with, applied to or bonded with the transparent polymer sheet or the imaged thin polymer sheet, the water vapor transmission rate can be adjusted to achieve the desired photographic or imaging results. One or more of the layers comprising the thin imaged polymer sheet may contain $TiO_2$ or other inorganic pigment. In addition one or more of the layers comprising the thin imaged polymer sheet may be voided. Other materials that can be used to enhance the water vapor transmission characteristics comprise at least one material from the group consisting of polyethylene terephthalate, polybutylterephthalate, acetates, cellophane polycarbonates, polyethylene vinyl acetate, ethylene vinyl acetate, methacrylate, polyethylene methylacrylate, acrylates, acrylonitrile, polyester ketone, polyethylene acrylic acid, polychlorotrifluoroethylene, polychlorotrifluoroethylene, polytetrafluoroethylene, amorphous nylon, polyhydroxyamide ether, and metal salt of ethylene methacrylic acid copolymers.

Another method of reducing the water vapor transmission rate of either the thin imaged polymer sheet or the transparent polymer sheet overlaying the image and brace is to coat a layer of low vapor transmission material that has been dispersed or mixed in either an organic or aqueous solvent by any method known in the art such as roller, gravure, curtain, or bead coating. In the production of a suitable layer having low moisture transmission rates, preferably hydrophobic water-insoluble synthetic polymers are used. These polymers are applied as a coating from a solution in an organic solvent or mixture of solvents. Preferred examples of such polymers include addition-type polymers and interpolymers prepared from ethylenically unsaturated monomers which include acrylates and methacrylates such as methyl acrylate, ethyl acrylate, butyl acrylate, hexyl acrylate, n-octyl acrylate, 2-ethylhexyl acrylate, nonyl acrylate, benzyl acrylate, lauryl acrylate, methyl methacrylate, ethyl methacrylate, butyl methcrylate, hexyl methacrylate, n-octyl methacrylate, 2-ethylhexyl methacrylate, nonyl methacrylate, benzyl methacrylate, lauryl methacrylate, dialkyl itaconates, dialkyl maleates, acrylonitrile and methacrylonitrile, styrenes including substituted styrenes, vinyl acetates, vinyl ethers, vinyl and vinylidene halides, and olefins such as butadiene and isoprene. Other polymers that may be effectively employed for the purpose of the present invention include organic solvent soluble condensation polymers such as cellulose derivatives, including cellulose nitrate, cellulose acetate, cellulose acetate proprionate, cellulose acetate butyrate, and the like, polycarbonates, polyurethanes, polyesters, epoxies, and polyamides.

A second means to achieve the desired water vapor transmission rate is the use of hydrophobic polymers coated on the transparent polymer sheet or the thin imaged polymer sheet from an aqueous dispersion or latex by any method known in the art. When applied to the thin polymer sheet overlaying the image and brace said layer should be transparent but if applied to the thin imaged polymer sheet it may be either transparent or opaque. Preferred examples of particularly suitable aqueous dispersions include water dispersible polyurethanes and polyesters. Examples of suitable latex polymers include addition-type polymers and interpolymers prepared from the above mentioned ethylenically unsaturated monomers. The latex polymers may be prepared by conventional emulsion polymerization methods. The latex polymers may be core-shell polymers as described in U.S. Pat. No. 4,497,917.

The hydrophobic polymers which are applied from organic solvent or aqueous media may contain reactive functional groups capable of forming covalent bonds by intermolecular cross-linking or by reaction with a cross-linking agent (i.e., a hardener). Suitable reactive functional groups include hydroxyl, carboxyl, carbodiimide, amino, amide, allyl, epoxide, aziridine, vinyl sulfone, sulfinic acid, and active methylene.

Said material can be selected and coated or otherwise applied to the sheet in an amount to provide the desired water vapor barrier. The preferred material for the thin imaged polymer sheet is a biaxially oriented polyolefin sheet that is coated with high barrier polyvinylidene chloride in a range of coverage 1.5 to 6.2 g/m$^2$. Polyvinyl alcohol can also be used but is less effective under high relative humidity conditions. Through the use of at least one of these materials in combination with a biaxially oriented sheet and a polymer tie layer, it has been shown that improved rates of emulsion hardening can be achieved. The preferred material for the transparent polymer sheet is a non-oriented polymer sheet that is coated with high barrier polyvinylidene chloride in a range of coverage 1.5 to 6.2 g/m$^2$.

A barrier layer to control the rate of water vapor transmission can also be achieved by the use of a metal foil layer laminated to a brace or metallized layer(s) coated or otherwise applied to the brace. The sheets of metal foil can be attached to the brace with the use of a melt polymer or adhesive coating. In the case in which the metal layer(s) are applied under the photo sensitive or imaging layer(s), a layer of polyethylene was applied to provide for better adhesion of the photo imaging layer to the base. In the case in which the metallized layer is incorporated with the biaxially oriented sheet of polypropylene that serves as the or part of the brace or as the thin imaged polymer sheet, the metallized layer is vacuum deposited on the thin imaged polymer sheet. The metal or metallized layer can comprise at least one material from the following list of aluminum, nickel, steel, gold, zinc, copper, titanium, metallic alloys as well as inorganic compounds such as silicon oxides, silicon nitrides, aluminum oxides or titanium oxides. The preferred material comprises a vacuum deposited layer of aluminum and one or more layers of polyolefin. This material has a water vapor transmission rate of less than $0.85\times10^{-5}$ g/m$^2$/day. The prior art for use of a metallized layer with films of polypropylene and coating of other substances to control water vapor transmission is noted in U.S. Pat. No. 5,192,620. The indicated use is for packaging applications.

In a preferred embodiment of this invention, the mechanically assembled picture has a polyolefin transparent sheet that is shrunk and overlays the image and brace. Said transparent polyolefin may have varying degrees of orientation or annealing. Control of these properties is critical to control the amount of dimensional change during the shrinking process. High levels of shrinkage may apply excessive stress on the mechanically assembled picture. The level of stress or force after shrinking may require that thicker and stiffer brace materials be used. Polyolefins and copolymers of polyolefin are preferred because they are low in cost and provide good protection. When additional durability is needed for scratch resistance, minimizing fingerprints and improving overall tearability properties; polyester sheets are preferred. In general polyester and copolyesters are more durable. A further advantage is that polyesters are higher in modulus may provide greater stiffness than other polymers. In a further embodiment of this invention the transparent polymer sheet that is shrunk to the thin imaged polymer sheet and brace is a polyamide sheet. Polyamides are preferred in some cases because they have a unique feel and durability. Furthermore the desire to control the oxygen and water vapor transmission rates in the final mechanical assembled picture may influence the decision to use polyamides. When the ultimate in durability for scratch resistant is desired a polycarbonate sheet may be used.

Whether a polyolefin, polyester, polyamide, polycarbonate, vinyls or other transparent polymer sheet is used, additional properties may be desirable. Typically one customer dissatisifer is fingerprints. Polymer sheets by themselves provide some added degree of wipeability over conventional imaged materials particular for fingerprints and spills. The incorporation of matte particles into the polymer sheet or in a layer on the polymer sheet is highly desirable to minimize fingerprinting. The irregular surface reduces the contact area for fingerprints and makes them less visible and certain matting materials will help to absorb the fingerprint oils, therefore making them less objectionable. In addition to matte particles, the surface of the transparent film may be roughened by mechanical embossing when the polymer sheet is cast or may be roughen prior to or after it is assembled with the brace and thin imaged polymer sheet. A further means of achieving a rough or matte appearing in the transparent polymer sheet is to utilize a mixture or blend of dissimilar polymers. In a further embodiment of this invention the transparent polymer sheet overlaying said image and brace may further comprise ultraviolet absorbers. Ultraviolet energy can break polymer bonds, react with residual monomer or catalyst or other materials to form hydroperoixdes or carbonyl groups. Any ultraviolet absorber may be used. Typical ones include hydroxybenzophenones, hydroxyphenyl benzotriazoles, hindered amine light stabilizers, metallic salts, pigments such as $TiO_2$, ZnO. Since the polymer sheet of this invention is transparent, pigments are not desirable. In addition to ultraviolet absorbers, the polymer sheets may also contain a variety of additives. These include antioxidants, tinting compounds such as blue and red colorants, optical brighteners, antiblocks, and slip agents. When the polymer sheet comprises a white pigment and wherein at least one layer may contain polyolefin and, in particular, polypropylene further comprising a white pigment such as $TiO_2$, the layer may contain any of the hindered phenol primary antioxidants commonly used for thermal stabilization of polypropylene, alone or in combination with a secondary antioxidants. Examples of hindered phenol primary antioxidants include benzenepropanoic acid, 3,5-bis(1,1-dimethylethyl)-4-hydroxy-, 2,2-bis[[3-[3,5-bis(1,1-dimethylethyl)-4-hydroxyphenyl]-1-oxopropoxy]methyl]-1,3-propanediyl ester (such as Irganox 1010), benzenepropanoic acid, 3,5-bis(1,1-dimethylethyl)-4-hydroxy-, octadecyl ester (such as Irganox 1076), (such as Irganox 1035), phenol, 4,4',4"-[(2,4,6-trimethyl-1,3,5-benzenetriyl)tris(methylene)]tris[2,6-bis(1,1-dimethylethyl) (such as Irganox 1330), but are not limited to these examples. Secondary antioxidants include organic alkyl and aryl phosphites including examples such as Phosphorous acid, bis[2,4-bis(1,1-dimethylethyl)-6-methylphenyl] ethyl ester (such as Irgafos 38), ethanamine, 2-[[2,4,8,10-tetrakis(1,1-dimethylethyl)dibenzo[d,f][1,3,2]-dioxaphosphepin-6-yl]oxy]-N,N-bis[2-[[2,4,8,10-tetrakis(1,1-dimethylethyl)dibenzo[d,f][1,3,2]dioxaphosphepin-6-yl]oxy]ethyl] (such as Irgafos 12), phenol, 2,4-bis(1,1-dimethylethyl), phosphite (such as Irgafos 168). A preferred embodiment uses Irgafos 168.

In the formation of an assembled picture, a preferred embodiment is that the transparent sheet overlaying the image and brace has a modulus of 350 MPa. A transparent sheet of this modulus is important to assure that the completed picture has acceptable stiffness and that the transparent sheet is sufficiently tough to be assembled with the image and the brace. Higher modulus sheets will help hold the individual elements together better and are better able to withstand handling abuses. An additional embodiment in this invention incorporates a bag as the transparent polymer sheet. In this preferred embodiment a preformed bag allows for quick filling of said bag with the imaged print and then pulling a vacuum in the bag and sealing it. A further embodiment then heat shrinks the bag to assure a tight fit. An additional embodiment utilizes a transparent polymer sheet or a transparent polymer bag with a roughness of at least 0.3 micrometers at a spatial frequency of at least 5 micrometers or greater on at least one side. Such a roughness provides a different and unique feel. The roughness may be matched to that of traditional photographic paper to provide a textured or matte appearing assembled picture. This not only provides a print that reduces gloss, but also aids in the process of filling the bags by reducing the coefficient of friction. It is preferred to have the roughness on the outer side of the bag or polymer sheet. This outer and front location is preferred because it provides a print with reduced fingerprint propensity, as well as reducing excessive glossy. In high speed packaging applications of prints, it may also be desirable to have some degree of roughness associated with the back side. This is desirable to minimize scratches and to optimize the backside coefficient of friction to prevent jams in the packaging equipment and assure good stacking. In some cases the roughness can be in the sheet or bag prior to filling, sealing, evacuating, and or shrinking. Additional variation of this is to have the roughness in either or both the image element and brace. When the transparent polymer sheet or bag is heat shrunk the texture pattern with show through. In most of these cases the polymer sheet still has high gloss sheen associated to it. A further embodiment comprises a substantially transparent sheet or bag with a gloss-reducing layer. Such a layer may include light scattering materials such as silica, silca gels, sol gels, glass beads, polymeric beads, pigments, and voids. A mixture of immesible polymers may also be used to create a roughened surface with minimal sheen. Typically polymer that may be used as the binder include vinyl, vinyl alcohol, vinyl acetates copolymer, vinyl chloride copolymers, vinylidene chloride, cellulose triacetate, cellulose propionate, polystyrene, polystyrene copolymers, styrenebutylmethacrylate copolymers, styrene-allyl alcohol copolymers, gelatin, polyester and copolyesters, vinyl pyridine and other derivatives, acrylates and copolymers of acrylates such as but nor exclusive to poly(methylmethacrylate), poly(ethyl methacrylate), polyamides resin, polysulfones, aromatic ester carbonate copolymers, polycarbonates, methylstyrene-dimethylsiloxane block copolymers, dimethyl siloxane-bisphenol copolymers and mixtures thereof.

Another preferred embodiment of this invention comprises a transparent polymer bag that further comprises a tab. The tab may have holes that are precut or punched to be accepted rings or other fastening devices such that the mechanically assembled picture can then placed into a photoalbum or notebook.

In an additional embodiment of this invention the brace should be substantially opaque to prevent show through and may further have a white surface in contact with the image element. The white brace provides a good reflective background when viewing the image. In the embodiment where the thin imaged polymer sheet is also white and opaque, the brace material may be transparent. This provides additional options for the selection of the brace material. It would be possible to use a brown or unbleached kraft brace and still have a pleasing white reflective picture. This is important because lower cost materials may be used. Optional filler materials is selected from the group consisting of titanium dioxide, colloidal silica, barium sulfate, zinc sulfide, hydrated alumina, calcium silicate, calcium carbonate, zirconium oxide, blends of filler as well as microspheres.

In this invention the brace material may have a stiffness of at least 150 Newtons. Such stiffness provides a strong brace that will resist the force of the transparent polymer sheet once it has been shrunk. In an additional embodiment of this invention, the mechanically assembled picture has a stiffness of greater than 150 millinewtons. Most photographic and other imaging materials have a unique feel to them. Most customers perceive superior print quality, with substantial stiffness and feel. It is therefore an important aspect of this invention to provide a mechanical assembled picture with adequate stiffness.

Another embodiment of a mechanically assembled picture comprises a brace and/or transparent polymer sheet that further comprises a fragrance. The fragrance material is selected from the group consisting of: isoamylacetate, ethyl2-methyl butyrate, n-hexanal, damascenone, muscone, ethylene brssylate, ethylenedodecanedioate, eremophilone, anethole, isobutyl-2-butenedioate, 2.5-dimethyl-4-hydroxy-3 (2H)-furanone, carvone, benzaldehyde, tilylaldehyde, bezzylacetate, 5-methyl-2-phenyl-2-hexenal, iso amyl butyrate, vanilin, isoamyl phenylacetate, furfurylmercaptan, furfuryl thioprop-ionate, α-nonalactone, 2-methoxy-5-methyl pyrazine, cinnamic aldehyde, ethyloenanthate, 2-methyl-2-pentenoic acid, methylanthranilate, ethyl 3-hydroxybutyrate, nootktone, methyl (methylthio) pyrazine, bezylatacetate, indole, citral, α-terpineol, β-sinensal, ethyl anthranilate, thymol, octylaldehyde, decyl aldehyde, 2-methyl-3-92-tolypropionaldehyde, hydroxy citronella dimethyl 2-phenylpropionaldehyde, 2-methyl-3-(4-isoproylphenyl) propionaldehyde, 3-methyl-1,2-cyclopentanedione, menthol, 3-methylthio-1,2-hexanol, a-undeca lactone, 6-amyl-60-pyrone, 2,5-dimethylpyrazine, ethyidecane-cis-4-trans-2-thiopropionate, allyl cyclohexane propionate, 6-methyl-60-ionone, trans-60-ionone, 4-(4-hydroxyphenyl)-2-butanone, ethylmaltol, methylcinnamate, 4-hydroxy-2,5-dimethyl-3(2H)-furanone, ethymethyphenylglycidate, ethylvanilin, propenyl quathol and mixtures thereof. Said fragrance may be applied to the transparent polymer layer, the brace or to the imaged thin polymer sheet.

A further embodiment of this invention in which a mechanical assembled picture has at least one imaging element with an image on a thin polymer sheet and a brace with a transparent sheet mechanically holding the image and brace may further contain a desiccant. The desiccant material may be any material that absorbs or holds water in its structure. Typical desiccants are hydroscopic substances such as activated alumia, calcium chloride, silica gel, zinc chloride, microporous materials composed either aluminia silicates, chemically similar to clays and feldspars, zeolites or crystalline aluminophosphates derived from mixtures containing an organic amine or quaternary ammonium salts. The microporous material should have a pore size from 5 to 10 angstroms to help optimize the absorption of water.

One preferred embodiment of this invention has a brace that contains cellulose fiber. The brace may be photographic paper, plain paper, coated paper, polymer coated paper, kraft paper, non-woven cellulose, cardboard, wood, wood derivatives or other materials. In further embodiment of this invention the brace may comprise a voided polymer sheet. Such a sheet may include but is not exclusive to biaxially oriented polymer sheets of polyolefins, polyesters, polyamindes, polycarbonates, polystryene. Such sheets may further contain layers of similar or dissimilar polymers that further comprise pigments and other additives. In the case where the voided sheet is a polyolefin, any suitable biaxially oriented polymer sheet may be used. Microvoided composite biaxially oriented sheets are preferred and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462 and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\ \text{of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

"Void" is used herein to mean devoid of added solid and liquid matter, although it is likely the "voids" contain gas. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape that is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

In another case either the brace or the polymer sheet of the imaging element may use a voided polyester sheet. The voided polyester sheet may be voided throughout the layer or as a part of the layer with additional solid layer that add functionality. The polyester base sheet utilized as the support material of the invention should have a glass transition temperature between about 50° C. and about 150° C., preferably about 60–100° C., should be orientable, and have an intrinsic viscosity of at least 0.50, preferably 0.6 to 0.9. Suitable polyesters include those produced from aromatic, aliphatic or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoiso-phthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol and 1,4-cyclohexanedimethanol. Poly (ethylene terephthalate), which may be modified by small amounts of other monomers, is especially preferred. Polypropylene is also useful. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

Suitable cross-linked polymers for the microbeads used in void formation during sheet formation are polymerizable organic materials which are members selected from the group consisting of an alkenyl aromatic compound having the general formula

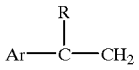

wherein Ar represents an aromatic hydrocarbon radical, or an aromatic halohydrocarbon radical of the benzene series and R is hydrogen or the methyl radical; acrylate-type monomers including monomers of the formula

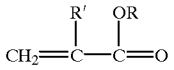

wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having the formula

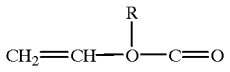

wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$, wherein n is a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, oiallyl fumarate, diallyl phthalate and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening to produce beads spanning the range of the original distribution of sizes. Other processes such as suspension polymerization, limited coalescence, directly yield very uniformly sized particles. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred. As the slip agent, colloidal silica is preferred.

It is preferred to use the "limited coalescance" technique for producing the coated, cross-linked polymer microbeads. This process is described in detail in U.S. Pat. No. 3,615,972. Preparation of the coated microbeads for use in the present invention does not utilize a blowing agent as described in this patent, however.

The following general procedure may be utilized in a limited coalescence technique:

1. The polymerizable liquid is dispersed within an aqueous nonsolvent liquid medium to form a dispersion of droplets having sizes not larger than the size desired for the polymer globules, whereupon
2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and
3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and
4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid, and hence the diameter of the beads of polymer, can be varied predictably, by deliberate variation of the composition of the aqueous liquid dispersion, within the range of from about one-half of a micrometer or less to about 0.5 centimeter. For any specific operation, the range of diameters of the droplets of liquid, and hence of polymer beads, has a factor in the order of three or less as contrasted to factors of 10 or more for diameters of droplets and beads prepared by usual suspension polymerization methods employing critical agitation procedures. Since the bead size, e.g., diameter, in the present method is determined principally by the composition of the aqueous dispersion, the mechanical conditions, such as the degree of agitation, the size and design of the apparatus used, and the scale of operation, are not highly critical. Furthermore, by employing the same composition, the operations can be repeated, or the scale of operations can be changed, and substantially the same results can be obtained.

The present method is carried out by dispersing one part by volume of a polymerizable liquid into at least 0.5, preferably from 0.5 to about 10 or more, parts by volume of a nonsolvent aqueous medium comprising water and at least the first of the following ingredients:

1. A water-dispersible, water-insoluble solid colloid, the particles of which, in aqueous dispersion, have dimensions in the order of from about 0.008 to about 50 micrometers, which particles tend to gather at the liquid-liquid interface or are caused to do so by the presence of
2. A water-soluble "promotor" that affects the "hydrophilic-hydrophobic balance" of the solid colloid particles; and/or
3. An electrolyte; and/or
4. Colloid-active modifiers such as peptizing agents, surface-active agents and the like; and, usually,
5. A water-soluble, monomer-insoluble inhibitor of polymerization.

The water-dispersible, water-insoluble solid colloids can be inorganic materials such as metal salts or hydroxides or clays, or can be organic materials such as raw starches, sulfonated cross-linked organic high polymers, resinous polymers and the like.

The solid colloidal material must be insoluble but dispersible in water and both insoluble and non-dispersible in, but wettable by, the polymerizable liquid. The solid colloids must be much more hydrophilic than oleophilic so as to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size is approximately that of the swollen particle. The particles can be essentially single molecules, as in the case of extremely high molecular weight cross-linked resins, or can be aggregates of many molecules. Materials that disperse in water to form true or colloidal solutions in which the particles have a size below the range stated or in which the particles are so diffuse as to lack a discernible shape and dimension are not suitable as stabilizers for limited coalescence. The amount of solid colloid that is employed is usually such as corresponds to from about 0.01 to about 10 or more grams per 100 cubic centimeters of the polymerizable liquid.

In order to function as a stabilizer for the limited coalescence of the polymerizable liquid droplets, it is essential that the solid colloid must tend to collect with the aqueous liquid at the liquid-liquid interface, i.e., on the surface of the oil droplets. (The term "oil" is occasionally used herein as generic to liquids that are insoluble in water.) In many instances, it is desirable to add a "promoter" material to the aqueous composition to drive the particles of the solid colloid to the liquid-liquid interface. This phenomenon is well known in the emulsion art, and is here applied to solid colloidal particles, as a expanded of adjusting the "hydrophilic-hydrophobic balance."

Usually, the promoters are organic materials that have an affinity for the solid colloid and also for the oil droplets and that are capable of making the solid colloid more oleophilic. The affinity for the oil surface is usually due to some organic portion of the promoter molecule while affinity for the solid colloid is usually due to opposite electrical charges. For example, positively charged complex metal salts or hydroxides, such as aluminum hydroxide, can be promoted by the presence of negatively charged organic promoters such as water-soluble sulfonated polystyrenes, alignates and carboxymethylcellulose. Negatively charged colloids, such as Bentonite, are promoted by positively charged promoters such as tetramethyl ammonium hydroxide or chloride or water-soluble complex resinous amine condensation products such as the water-soluble condensation products of diethanolamine and adipic acid, the water-soluble condensation products of ethylene oxide, urea and formaldehyde, and polyethylenimine. Amphoteric materials such as proteinaceous materials like gelatin, glue, casein, albumin, glutin and the like, are effective promoters for a wide variety of colloidal solids. Nonionic materials like methoxycellulose are also effective in some instances. Usually, the promoter need be used only to the extent of a few parts per million of aqueous medium although larger proportions can often be tolerated. In some instances, ionic materials normally classed as emulsifiers, such as soaps, long chain sulfates and sulfonates and the long chain quaternary ammonium compounds, can also be used as promoters for the solid colloids, but care must be taken to avoid causing the formation of stable colloidal emulsions of the polymerizable liquid and the aqueous liquid medium.

An effect similar to that of organic promoters is often obtained with small amounts of electrolytes, e.g., water-soluble, ionizable alkalies, acids and salts, particularly those having polyvalent ions. These are especially useful when the excessive hydrophilic or insufficient oleophilic characteristic of the colloid is attributable to excessive hydration of the colloid structure. For example, a suitably cross-linked sulfonated polymer of styrene is tremendously swollen and hydrated in water. Although the molecular structure contains benzene rings which should confer on the colloid some affinity for the oil phase in the dispersion, the great degree of hydration causes the colloidal particles to be enveloped in a cloud of associated water. The addition of a soluble, ionizable polyvalent cationic compound, such as an aluminum or calcium salt, to the aqueous composition causes extensive shrinking of the swollen colloid with exudation of a part of the associated water and exposure of the organic portion of the colloid particle, thereby making the colloid more oleophilic.

The solid colloidal particles whose hydrophilic-hydrophobic balance is such that the particles tend to gather in the aqueous phase at the oil-water interface, gather on the surface of the oil droplets and function as protective agents during limited coalescence.

Other agents that can be employed in an already known manner to effect modification of the colloidal properties of the aqueous composition are those materials known in the art as peptizing agents, flocculating and deflocculating agents, sensitizers, surface active agents and the like.

It is sometimes desirable to add to the aqueous liquid a few parts per million of a water-soluble, oil-insoluble inhibitor of polymerization effective to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid is then admixed with the liquid polymerizable material in such a way as to disperse the liquid polymerizable material as small droplets within the aqueous medium. This dispersion can be accomplished by any usual means, e.g., by mechanical stirrers or shakers, by pumping through jets, by impingement, or by other procedures causing subdivision of the polymerizable material into droplets in a continuous aqueous medium.

The degree of dispersion, e.g., by agitation is not critical except that the size of the dispersed liquid droplets must be no larger, and is preferably much smaller, than the stable droplet size expected and desired in the stable dispersion. When such condition has been attained, the resulting dispersion is allowed to rest with only mild, gentle movement, if any, and preferably without agitation. Under such quiescent conditions, the dispersed liquid phase undergoes a limited degree of coalescence.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which can be as large as 0.3 and sometimes 0.5 centimeter in diameter, are quite stable as regards further coalescence and are remarkably uniform in size. If such a large droplet dispersion be vigorously agitated, the droplets are fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying this phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, i.e., on the surface of the oil droplets. It is thought that droplets which are substantially covered by such solid colloid are stable to coalescence while droplets which are not so covered are not stable. In a given dispersion of a polymerizable liquid the total surface area of the droplets is a function of the total volume of the liquid and the diameter of the droplets. Similarly, the total surface area barely coverable by the solid colloid, e.g., in a layer one particle thick, is a function of the amount of the colloid and the dimensions of the particles thereof. In the dispersion as initially prepared, e.g., by agitation, the total surface area of the polymerizable liquid droplets is greater than can be covered by the solid colloid. Under quiescent conditions, the unstable droplets begin to coalesce. The coalescence results in a decrease in the number of oil droplets and a decrease in the total surface area thereof up to a point at which the amount of colloidal solid is barely sufficient substantially to cover the total surface of the oil droplets, whereupon coalescence substantially ceases.

If the solid colloidal particles do not have nearly identical dimensions, the average effective dimension can be estimated by statistical methods. For example, the average effective diameter of spherical particles can be computed as the square root of the average of the squares of the actual diameters of the particles in a representative sample.

It is usually beneficial to treat the uniform droplet suspension prepared as described above to render the suspension stable against congregation of the oil droplets.

This further stabilization is accomplished by gently admixing with the uniform droplet dispersion an agent capable of greatly increasing the viscosity of the aqueous liquid. For this purpose, there may be used any water-soluble or water-dispersible thickening agent that is insoluble in the oil droplets and that does not remove the layer of solid colloidal particles covering the surface of the oil droplets at the oil-water interface. Examples of suitable thickening agents are sulfonated polystyrene (water-dispersible, thickening grade), hydrophilic clays such as Bentonite, digested starch, natural gums, carboxy-substituted cellulose ethers and the like. Often the thickening agent is selected and employed in such quantities as to form a thixotropic gel in which are suspended the uniform-sized droplets of the oil. In other words, the thickened liquid generally should be non-Newtonian in its fluid behavior, i.e., of such a nature as to prevent rapid movement of the dispersed droplets within the aqueous liquid by the action of gravitational force due to the difference in density of the phases. The stress exerted on the surrounding medium by a suspended droplet is not sufficient to cause rapid movement of the droplet within such non-Newtonian media. Usually, the thickener agents are employed in such proportions relative to the aqueous liquid that the apparent viscosity of the thickened aqueous liquid is in the order of at least 500 centipoises (usually determined by means of a Brookfield viscosimeter using the No. 2 spindle at 30 rpm). The thickening agent is preferably prepared as a separate concentrated aqueous composition that is then carefully blended with the oil droplet dispersion.

The resulting thickened dispersion is capable of being handled, e.g., passed through pipes, and can be subjected to polymerization conditions substantially without mechanical change in the size or shape of the dispersed oil droplets.

The resulting dispersions are particularly well suited for use in continuous polymerization procedures that can be carried out in coils, tubes and elongated vessels adapted for continuously introducing the thickened dispersions into one end and for continuously withdrawing the mass of polymer beads from the other end. The polymerization step is also practiced in batch manner.

The order of the addition of the constituents to the polymerization usually is not critical, but beneficially it is more convenient to add to a vessel the water, dispersing agent, and incorporated the oil-soluble catalyst to the monomer mixture, and subsequently add with agitation the monomer phase to the water phase.

The following is an example illustrating a procedure for preparing the cross-linked polymeric microbeads coated with slip agent. In this example, the polymer is polystyrene cross-linked with divinylbenzene. The microbeads have a coating of silica. The microbeads are prepared by a procedure in which monomer droplets containing an initiator are sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX (a colloidal suspension containing 50% silica sold by DuPont). A monomer phase is prepared by combining 3317 g styrene, 1421 g divinylbenzene (55% active cross-linking agent; other 45% is ethyl vinyl benzene which forms part of the styrene polymer chain) and 45 g VAZO 52 (a monomer-soluble initiator sold by DuPont). The mixture is passed through a homogenizer to obtain 5 micrometer droplets. The suspension is heated overnight at 52° C. to give 4.3 kg of generally spherical microbeads having an average diameter of about 5 micrometers with narrow size distribution (about 2–10 micrometers size distribution). The mol proportion of styrene and ethyl vinyl benzene to divinylbenzene is about 6.1%. The concentration of divinylbenzene can be adjusted up or down to result in about 2.5–50% (preferably 10–40%) cross-linking by the active cross-linker. Of course, monomers other than styrene and divinylbenzene can be used in similar suspension polymerization processes known in the art. Also, other initiators and promoters may be used as known in the art. Also, slip agents other than silica may also be used. For example, a number of LUDOX colloidal silicas are available from DuPont. LEPANDIN colloidal alumina is available from Degussa. NALCOAG colloidal silicas are available from Nalco and tin oxide and titanium oxide are also available from Nalco.

Normally, for the polymer to have suitable physical properties such as resiliency, the polymer is cross-linked. In the case of styrene cross-linked with divinylbenzene, the polymer is 2.5–50% cross-linked, preferably 20–40% cross-linked. By percent cross-linked, it is meant the mol % of cross-linking agent based on the amount of primary monomer. Such limited cross-linking produces microbeads which are sufficiently coherent to remain intact during orientation of the continuous polymer. Beads of such cross-linking are also resilient, so that when they are deformed (flattened) during orientation by pressure from the matrix polymer on opposite sides of the microbeads, they subsequently resume their normal spherical shape to produce the largest possible voids around the microbeads to thereby produce articles with less density.

The microbeads are referred to herein as having a coating of a "slip agent". By this term it is meant that the friction at the surface of the microbeads is greatly reduced. Actually, it is believed this is caused by the silica acting as miniature ball bearings at the surface. Slip agent may be formed on the surface of the microbeads during their formation by including it in the suspension polymerization mix.

Microbead size is regulated by the ratio of silica to monomer. For example, the following ratios produce the indicated size microbead:

| Microbead Size, Micrometers | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The microbeads of cross-linked polymer range in size from 0.1–50 micrometers, and are present in an amount of 5–50% by weight based on the weight of the polyester. Microbeads of polystyrene should have a Tg of at least 20° C. higher than the Tg of the continuous matrix polymer and are hard compared to the continuous matrix polymer.

Elasticity and resiliency of the microbeads generally result in increased voiding, and it is preferred to have the Tg of the microbeads as high above that of the matrix polymer as possible to avoid deformation during orientation. It is not believed that there is a practical advantage to cross-linking above the point of resiliency and elasticity of the microbeads.

The microbeads of cross-linked polymer are at least partially bordered by voids. The void space in the supports should occupy 2–60%, preferably 30–50%, by volume of the base. Depending on the manner in which the supports are made, the voids may completely encircle the microbeads, e.g., a void may be in the shape of a doughnut (or flattened doughnut) encircling a micro-bead, or the voids may only partially border the microbeads, e.g., a pair of voids may border a microbead on opposite sides.

During stretching the voids of the polyester base sheet assume characteristic shapes from the balanced biaxial orientation of paperlike sheets to the uniaxial orientation of microvoided/satin-like fibers. Balanced microvoids are largely circular in the plane of orientation while fiber microvoids are elongated in the direction of the fiber axis. The size of the microvoids and the ultimate physical properties depend upon the degree and balance of the orientation, temperature and rate of stretching, crystallization kinetics, the size distribution of the microbeads, and the like.

The polyester sheets of the invention are prepared by:

(a) forming a mixture of molten continuous matrixpolymer and cross-linked polymer wherein the cross-linked polymer is a multiplicity of microbeads uniformly dispersed throughout the matrix polymer, the matrix polymer being as described herein before, the cross-linked polymer microbeads being as described herein before, (b) forming a polyester base sheet from the mixture by extrusion or casting, (c) orienting the article by stretching to form microbeads of cross-linked polymer uniformly distributed throughout the article and voids at least partially bordering the microbeads on sides thereof in the direction, or directions of orientation.

The mixture may be formed by forming a melt of the matrix polymer and mixing therein the cross-linked polymer. The cross-linked polymer may be in the form of solid or semi-solid microbeads. Due to the incompatibility between the matrix polymer and cross-linked polymer, there is no attraction or adhesion between them, and they become uniformly dispersed in the matrix polymer upon mixing.

When the microbeads have become uniformly dispersed in the matrix polymer, a base is formed by processes such as extrusion or casting. Examples of extrusion or casting would be extruding or casting a sheet. Such forming methods are well known in the art. If sheets are cast or extruded, it is important that such article be oriented by stretching, at least in one direction. Methods of unilaterally or bilaterally orienting sheet are well known in the art. Basically, such methods comprise stretching the sheet at least in the machine or longitudinal direction after it is cast or extruded an amount of about 1.5–10 times its original dimension. Such sheet may also be stretched in the transverse or cross-machine direction by apparatus and methods well known in the art, in amounts of generally 1.5–10 (usually 3–4 for polyesters and 6–10 for polypropylene) times the original dimension. Such apparatus and methods are well known in the art and are described in such U.S. Pat. No. 3,903,234.

The voids, or void spaces, referred to herein surrounding the microbeads are formed as the continuous matrix polymer is stretched at a temperature above the Tg of the matrix polymer. The microbeads of cross-linked polymer are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The preferred preform stretching operation simultaneously opens the microvoids and orients the matrix material. The final product properties depend on and can be controlled by stretching time-temperature relationships and on the type and degree of stretch. For maximum opacity and texture, the stretching is done just above the glass transition temperature of the matrix polymer. When stretching is done in the neighborhood of the higher glass transition temperature, both phases may stretch together and opacity decreases. In the former case, the materials are pulled apart, a mechanical anticompatibilization process. Two examples are high-speed melt spinning of fibers and melt blowing of fibers and films to form non-woven/spun-bonded products. In summary, the scope of this invention includes the complete range of forming operations just described.

In general, void formation occurs independent of, and does not require, crystalline orientation of the matrix polymer. Opaque, microvoided sheets have been made in accordance with the methods of this invention using completely amorphous, non-crystallizing copolyesters as the matrix phase. Crystallizable/orientable (strain hardening) matrix materials are preferred for some properties like tensile strength and gas transmission barrier. On the other hand, amorphous matrix materials have special utility in other areas like tear resistance and heat sealability. The specific matrix composition can be tailored to meet many product needs. The complete range from crystalline to amorphous matrix polymer is part of the invention.

In the embodiment wherein a voided polystyrene or foam-board is used as a brace the voids may have a different geometry than that of a biaxially oriented sheet. When voids are formed by a chemical reaction, they may be more circular than lens or elongated. Materials of this type are preferred for their superior stiffness and feel.

The mechanically assembled picture of this invention may further use a thin imaged polymer sheet with a nonplanar brace wherein a transparent sheet mechanically holds the image to the brace. Traditional photographs and other images are relegated a flat planar surface such as paper or polyester sheets. By utilization a mechanical means of holding the image in place as well as utilizing transparent sheet that can be shrunk, the overlaying transparent sheet applies force to the thin imaged polymer sheet such that it forms and conforms to a nonplanar brace or a curved brace. The use of thin polymer sheets that have been imaged is critical since some nonplanar surfaces are rough and irregular in shape and size. By using a thin polymer sheet in can be more easily conformed to irregular shapes. By using a shrinkable transparent sheet to hold the imaged sheet to the brace, there is no need to be concerned about adhesives. By applying heat to localized areas the image can be made to conform more in one area versus another. Curved brace may also be used. In general the thin imaged polymer sheet may be more easily formed to a curved surface. This embodiment is preferred because it allows photographic quality or near photographic quality images to be assembled with a variety of shapes and contours.

In an additional embodiment of a mechanically assembled image, an image may be put in contact with each side of a brace. When the brace is a flat planar brace the image is put into contact with two sides. When the brace is an object such as a cube or pyramid, then multiple images may be brought into contact.

A preferred method of forming a mechanically assembled picture provides an image element and a brace and then placing the image element in contact with the brace placing a transparent polymer sheet over the image element and brace treating the transparent polymer sheet to cause it to permanently hold the image element in contact with the brace. In one embodiment the transparent polymer sheet is a heat shrinkable material. One means of getting the transparent polymer sheet to hold the image to the brace is to shrink the transparent polymer sheet after it has been wrapped around the brace and image element. The preferred means of shrinking the transparent sheet is to apply heat to said polymer sheet. In an additional embodiment of this invention said transparent polymer sheet comprises a pouch into which the brace and image element are placed and vacuum sealed.

In the method of forming a mechanically assembled picture with an image element and a brace wherein in the image element and brace are brought into contact with each other and then a transparent polymer sheet overlays the image element and brace, heat is applied to the heat shrinkage material to get excellent optical contact of the image element, brace and heat shrinkage material. In this embodiment more heat is applied to one area versus another to get conformity to nonplanar and curves surfaces. In a another embodiment of the method of this invention a vacuum is applied below the transparent polymer sheet. In this embodiment the transparent polymer sheet is not necessarily heat shrinkable. The vacuum helps to assure good optical contact as well as removes a substantial portion of oxygen in the mechanically assembled picture. This helps to minimize dye fade that is oxygen induced.

Another preferred method to assemble an image with a brace is to incorporate antistatic and friction layers. The antistat and friction layers provide a conductive path to prevent static and static cling, as well as to provide adequate sliding friction in the equipment used to mechanically assemble the picture elements. In the case of photosenstive images, the antistat is typically on the side of the thin polymer sheet that is opposite of the photosensitive layer. It is important to protect the photosenstive layer from static discharge to prevent premature exposure. In high speed picture assembling processes, it is also important to provide friction and static charge control on the transparent polymer sheet that overlays the image and brace. Said overlaying transparent polymer sheet may slide over various metal or plastic surfaces during the assembling process. To prevent jamming and stacking problems of the mechanically assembled picture elements, the outer surface of the polymer sheet overlaying the image and brace should also comprise electostatic charge and sliding friction control. Typical means to provide this is by the roughness of said polymer sheet, the use of conductive salts and particles in either the polymer itself or in a layer on the polymer sheet. The use of various lubricants, slip agents, waxes, and particles are known in the art to modify the frictional properties of thin polymer sheets.

In a further embodiment of the method of this invention, the brace may be selected from the group consisting of cellulose, paper, cardboard, biaxially oriented sheets, polyester sheets, polyamide sheets, polycarbonate sheets, polyolefin sheets, cloth, polystyrene, foam board, metallized polymer sheet, laminated composites, wood, metal, plastics as well as mixtures and combinations of the above. When mechanically assembling a picture, handling of the image element as well as the transparent polymer sheet may result in unsightly fingerprints, scratches and other imperfections. In an additional embodiment of the method of this invention the transparent polymer sheet may also comprise ultraviolet, fingerprint and abrasion protection. Ultraviolet absorbers may be needed to prevent fading of the imaging dyes or pigments. Viewing and handling of prints may result in unsightly fingerprints and scratches. The incorporation of a slightly roughened surface or particles in a tough binder such as polyurethane, acrylic latex and others on the outer surface of the overlaying polymer sheet is important in minimizing potential damage to the final assembled print.

The image may be formed by light sensitive silver halide materials, dye forming couplers, ink jet, thermal dye sublimations or electrophotographic methods.

The thermal dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount that is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB Patent 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photorecptors.

In one form of the electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In one form of the electrophotographic process, a photosensitive element is permanently imaged to form areas of differential conductivity. Uniform electrostatic charging, followed by differential discharge of the imaged element, creates an electrostatic image. These elements are called electrographic or xeroprinting masters because they can be repeatedly charged and developed after a single imaging exposure.

In an alternate electrographic process, electrostatic images are created ionographically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the paper. For heat-fusible toners, thermoplastic polymers are used as part of the particle. Heating both removes residual liquid and fixes the toner to paper.

The terms IRL refers to image or ink receiving layer. The term TL refers to tie layer. The ink receiving layer or IRL for ink jet imaging may be applied by any known methods, such as solvent coating, or melt extrusion coating techniques. The IRL is coated over the TL at a thickness ranging from 0.1–10 $\mu$m, preferably 0.5–5 $\mu$m. There are many known formulations that may be usefull as dye receiving layers. The primary requirement is that the IRL is compatible with the inks which it will be imaged so as to yield the desirable color gamut and density. As the ink drops pass through the IRL, the dyes are retained or mordanted in the IRL, while the ink solvents pass freely through the IRL and are rapidly absorbed by the TL. Additionally, the IRL formulation is preferably coated from water, exhibits adequate adhesion to the TL, and allows for easy control of the surface gloss.

For example, Misuda et al. in U.S. Pat. Nos. 4,879,166; 5,264,275; 5,104,730; 4,879,166; and Japanese Patents 1,095,091; 2,276,671; 2,276,670; 4,267,180; 5,024,335; and 5,016,517 discloses aqueous based IRL formulations comprising mixtures of psuedo-bohemite and certain water soluble resins. Light in U.S. Pat. Nos. 4,903,040; 4,930,041; 5,084,338; 5,126,194; 5,126,195; 5,139,867; and 5,147,717 discloses aqueous-based IRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable DRL formulations based on poly (vinyl alcohol). Iqbal in U.S. Pat. No. 5,208,092 discloses water-based IRL formulations comprising vinyl copolymers that are subsequently cross-linked. In addition to these examples, there may be other known or contemplated IRL formulations, which are consistent with the aforementioned primary and secondary requirements of the DRL, all of which fall under the spirit and scope of the current invention.

The preferred IRL is a 0.1–10 $\mu$m IRL which is coated as an aqueous dispersion of 5 parts alumoxane and 5 parts poly (vinyl pyrrolidone). The IRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers, and the like.

Although the ink-receiving elements as described above can be successfully used to achieve the objectives of the present invention, it may be desirable to overcoat the IRL for the purpose of enhancing the durability of the imaged element. Such overcoats may be applied to the IRL either before or after the element is imaged. For example, the IRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants, and the like. Inks preferred for use in combination with the image recording elements of the present invention are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory ofthe Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals that reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 Al (Makino).

The photographic elements of this invention may use emulsions doped with Group VIII metals such as iridium, rhodium, osmium, and iron as described in *Research Disclosure*, September 1996, Item 38957, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following Table, reference will be made to (1) *Research Disclosure*, December 1978, Item 17643, (2) *Research Disclosure*, December 1989, Item 308119, and (3) *Research Disclosure*, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, | morphology and preparation. |
| | XI, XII, | Emulsion preparation |
| | XIV, XV | including hardeners, coating |
| | I, II, III, IX | aids, addenda, etc. |
| 3 | A & B | |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, | materials; Antistatic layers; |
| | XVI | matting agents |

-continued

| Reference | Section | Subject Matter |
|---|---|---|
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The mechanically assembled pictures of the invention may have copy restriction features incorporated such as disclosed in U.S. Pat. Nos. 5,752,152 and 5,919,730 which disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the back side to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial, and spectral exposure of the photosensitive materials to visible or non-visible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure* 37038 of February 1995. These and other advantages will be apparent from the detailed description below.

The following examples illustrate the practice of this invention. They are not intended to be exhaustive of all possible variations of the invention. Parts and percentages are by weight unless otherwise indicated.

EXAMPLES

Example 1

| Mechanically Assembled Picture |
|---|
| Transparent Heat Shrinkable Polymer Sheet |
| Ink jet Formed Image |
| Polyethylene Skin Layer with Blue/Red colorants |
| 24% Rutile Dupont R-101 $TiO_2$ in Oriented Polypropylene |
| Voided Polypropylene |
| 24% Rutile Dupont R 101 $TiO_2$ in Oriented Polypropylene |
| Clear Polypropylene |
| 500 Micrometer Cardboard Brace |
| Transparent Heat Shrinkable Polymer Sheet |

Thin Polymer Sheet of the Imaging Element

The thin polymer sheet used in this example was coextruded and biaxially oriented. Table 1 below lists the characteristics of the layers of the biaxially oriented sheet used in this example. The sheet consists of 5 layers identified as L1, L2, L3, L4, and L5. L1 is the thin colored layer on the top of the biaxially oriented sheet to which the ink jet dye receiving layer was coated. L2 is the layer to which optical brightener and $TiO_2$ was added. The optical brightener used was Hostalux KS manufactured by Ciba-Geigy. Rutile $TiO_2$ was added to the L2 at 24% by weight of base polymer. The $TiO_2$ type was DuPont R104 (a 0.22 $\mu$m particle size $TiO_2$). The L3 layer for the biaxially oriented sheet is microvoided and further described in Table 2 where the refractive index and geometrical thickness is shown for measurements made along a single slice through the L3 layer; they do not imply continuous layers; a slice along another location would yield different but approximately the same thickness. The areas with a refractive index of 1.0 are voids that are filled with air, and the remaining layers are polypropylene. L3 is a voided polypropylene layer using PBT as the voiding agent. PBT is present in this layer at approximately 8% by weight of the L3 layer.

TABLE 1

| Layer | Material | Thickness, $\mu$m |
|---|---|---|
| L1 | LD Polyethylene + color concentrate | 0.75 |
| L2 | Polypropylene + $TiO_2$ + OB | 4.32 |
| L3 | Voided Polypropylene | 24.9 |
| L4 | Polypropylene + $TiO_2$ | 4.32 |
| L5 | Polypropylene | 0.762 |
| L6 | LD Polyethylene | 11.4 |

TABLE 2

| Sublayer of L3 | Refractive Index | Thickness, $\mu$m |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

An ink jet image receiving layer was utilized to prepare the translucent display material of this example and was coated on the L1 polyethylene layer on the top biaxially oriented sheet. The ink jet image receiving layer was coated by means of an extrusion hopper, a dispersion containing 326.2 g of gelatin, 147 g of BVSME hardener, i.e., bis (vinylsulfonylmethyl) ether 2% solution in water, 7.38 g of a dispersion containing 2.88g of 11.5 $\mu$m polystyrene beads, 18 g of DispeX™ (40% solution in water obtained from Allied Colloids, Inc.), and 4.32 g of water, and 3.0 g of a 20% solution in water of Surfactant 10G (nonylphenoxypolyglycidol) obtained from Olin Matheson Company. The about 5 $\mu$m (dried thickness).

Onto this layer was coated by means of an extrusion hopper an aqueous solution containing 143.5 g of a 3% solution in water of 4.42 g of hydroxypropyl cellulose (Methocel KLV100, Dow Chemical Company), 0.075 g of vanadyl sulfate, 2-hydrate obtained from Eastman Kodak Company, 0.075 g of a 20% solution in water of Surfactant 10G (nonylphenoxypolyglycidol) obtained from Olin Matheson Company, and 145.4 g of water; and 0.45 g of a 20% solution in water of Surfactant 10G (nonylphenoxypolyglycidol) obtained from Olin Matheson Company and 79.5 g of water to form an ink-receiving layer about 2 micrometers in thickness (dry thickness).

An image was printed onto the ink jet receiving layer using a commercially available ink jet printer. The imaged imaging layer was then placed on top of a brace material. In this example the brace was a 500 μm thick smooth cardboard stock. Both the imaged polymer sheet and the smooth cardboard brace were then wrapped with a heat shrinkable 15 μm polyolefin film. The edges of the heat shrinkable film were heat sealed and trimmed. Heat was then uniformly applied to the film causing it to shrink and form a tight fit around the imaged polymer sheet and brace. The polyolefin film was a commercially available shrink film. The film used was Cryvoc D-955 Film. No adhesives were used to hold the imaged polymer film to the brace. The heat shrink film was then heated to approximately 200° F. causing the heat shrink film to contract and tightly wrap the imaged polymer sheet and brace. The edges were trimmed to form a mechanically assembled picture that was completed encapsulated on the top, bottom and edges.

Example 2

This example is identical to Example 1 except the 500 μm smooth ardboard brace was replaced with a rigid voided styrene foam board that was pproximately 800 μm thick.

Example 3

Pre Formed Transparent Heat Sealable Polymer Pouch
Exposed/Processed Color Dyed Formed Image
50 μm Gel subbed both side Clear Polyester Sheet
Conductive/Antistat
75 g/m$^2$ Basis Weight White Paper Base
Pre Formed Transparent Heat Sealable Polymer Pouch Photographic grade polyester base The polyester base of this example is a polyethylene terephthalate transparent base, 50 micrometers thick that is primed and gelatin coated on the top side of the base to improve silver halide emulsion adhesion. The bottom side was coated with an electrically conductive antistat to minimize static problems through the coating and finishing process. The antistatic layers contain conjugated polymers, semiconductive metal halide salts, and semiconductive metal oxide particles. For this example tin oxide was used primary conductive particle using a gelatin based binder and silica particle to improve the frictional properties of the layer.

Color Dye Formed Layer

The polyester base was coated with a light sensitive silver halide color dye forming emulsion as disclosed by Format 1. Yellow emulsion YE1 was prepared by adding approximately equimolar silver nitrate and sodium chloride solutions into a well-stirred reactor containing gelatin peptizer and thioether ripener. Cesium pentachloronitrosylosmate was added from 1% to 70% of the making process, and potassium iodide was added at 93% of the making process to form a band of silver iodide in the grain. The resultant emulsion contained cubic shaped grains of 0.60 mm in edge length size. This emulsion was optimally sensitized by the addition of glutarydiaminophenylsulfide followed by the addition of a colloidal suspension of aurous sulfide and heat ramped to 60° C. during which time blue sensitizing dye, Dye 1, potassium hexachloroiridate, Lippmann bromide, and 1-(3-acetamidophenyl)-5-mercaptotetrazole were added.

Magenta emulsion ME1 was precipitated by adding approximately equimolar silver nitrate and sodium chloride solutions into a well-stirred reactor containing gelatin peptizer and thioether ripener. The resultant emulsion contained cubic shaped grains of 0.30 mm in edge length size. This emulsion was optimally sensitized by the addition of a colloidal suspension of aurous sulfide and heated to 55° C. The following were then added: potassium hexachloroiridate, Lippmann bromide, and green sensitizing dye, Dye 2. The finished emulsion was then allowed to cool, and 1-(3-acetamidophenyl)-5-mercaptotetrazole was added a few seconds after the cool down began.

Cyan emulsion CE1 was precipitated by adding approximately equimolar silver nitrate and sodium chloride solutions into a well-stirred reactor containing gelatin peptizer and thioether ripener. In addition, mercury was added during the make. The resultant emulsion contained cubic shaped grains of 0.40 mm in edge length size. This emulsion was optimally sensitized by the addition of Bis(1,4,5-trimethyl-1,2,4-triazolium-3-thiolate)gold(I)fluoroborate and sodium thiosulfate followed by heat digestion at 65° C. The following were then added: 1-(3-acetamidophenyl)-5-mercaptotetrazole, potassium hexachloroiridate, and potassium bromide. The emulsion was cooled to 40° C., and the red sensitizing dye, Dye 3, was added.

Emulsions YE1, ME1, and CE1 were combined with coupler-bearing dispersions by techniques known in the art and applied to laminated base of Example 1 according to the structure shown in Format 1 to prepare a photographic element of low curl and excellent strength characteristics.

Format 1

| | Item Description | Laydown mg/ft$^2$ |
|---|---|---|
| Layer 1 | Blue Sensitive Layer | |
| | Gelatin | 122 |
| | Yellow emulsion YE1 (as Ag) | 20 |
| | Y-1 | 45 |
| | ST-1 | 45 |
| | S-1 | 20. |
| Layer 2 | Interlayer | |
| | Gelatin | 70 |
| | SC-1 | 6. |
| | S-1 | 17 |
| Layer 3 | Green Sensitive Layer | |
| | Gelatin | 117 |
| | Magenta emulsion (as Ag) | 7 |
| | M-1 | 29 |
| | S-1 | 8 |
| | S-2 | 3 |
| | ST-2 | 2 |
| | ST-3 | 17.7 |
| | ST-4 | 57 |
| | PMT | 10 |
| Layer 4 | UV Interlayer | |
| | Gelatin | 68.44 |
| | UV-1 | 3 |
| | UV-2 | 17 |
| | SC-1 | 5.13 |
| | S-1 | 3 |
| | S-2 | 3 |
| Layer 5 | Red Sensitive Layer | |
| | Gelatin | 126 |
| | Cyan emulsion CE1 | 17 |
| | C-1 | 39 |
| | S-1 | 39 |
| | UV-2 | 25 |
| | S-2 | 3 |
| | SC-1 | 0.3 |
| Layer 6 | UV Overcoat | |
| | Gelatin | 48 |
| | UV-1 | 2 |
| | UV-2 | 12 |
| | SC-1 | 4 |
| | S-1 | 2 |
| | S-3 | 2 |

-continued
Format 1
| | Item Description | Laydown mg/ft$^2$ |
|---|---|---|
| Layer 7 | SOC | |
| | Gelatin | 60 |
| | SC-1 | 2 |
APPENDIX
Y-1
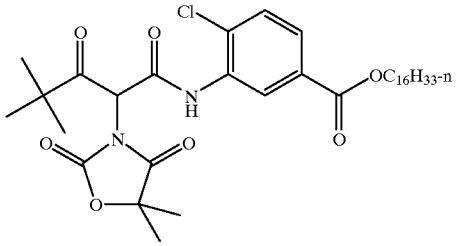
ST-1=N-tert-butylacrylamide/n-butyl acrylate copolymer (50:50)
S-1=dibutyl phthalate
SC-1
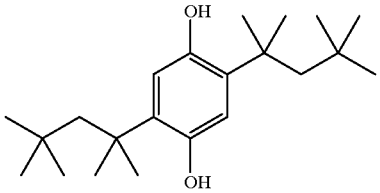
M-1
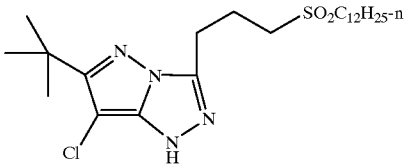
S-2=diundecyl phthalate
ST-2
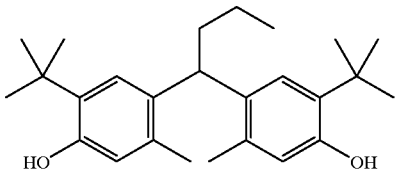
ST-3
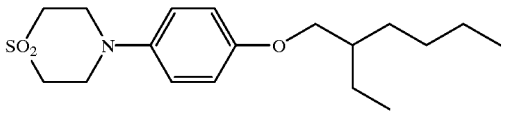
PMT=1-phenyl-5-mercaptotetrazole
ST-4
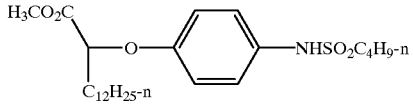
UV-1
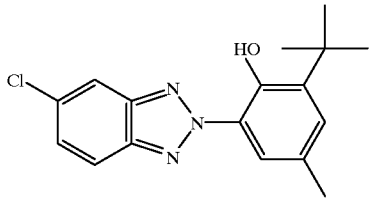
UV-2
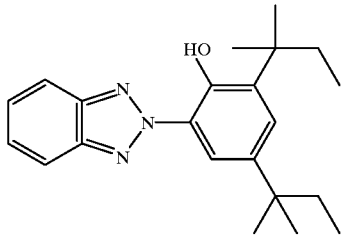
S-3=1,4-Cyclohexyldimethylene bis(2-ethylhexanoate)
C-1
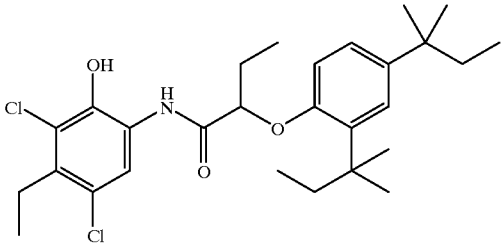
S-4=2-(2-Butoxyethoxy)ethyl acetate
Dye 1
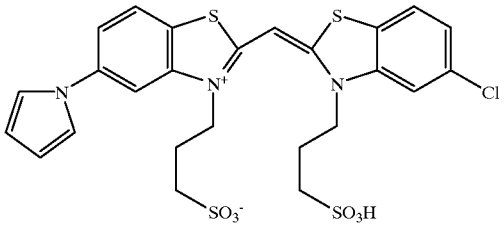
Dye 2
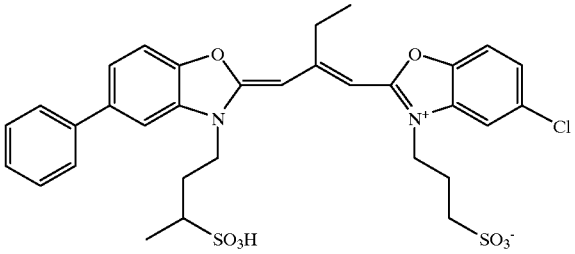

-continued

Dye 3

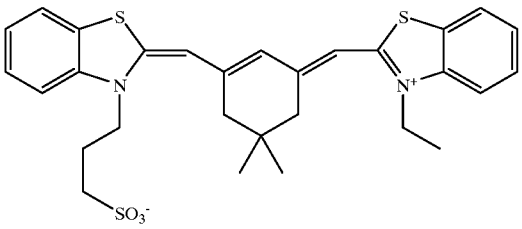

An image was formed by visible light exposed with a color negative. The exposed image was then processed using a conventional RA-4 processing chemistry. The formed image on the 50 $\mu$m polyester sheet was then placed on top of the paper base. The paper base used in this example was a commercially available copier grade cellulose paper based made by Hammermill Papers. The paper had a basis weight of approximately 75 g/m$^2$ and is their Tidal DP brand. Both the imaged polyester sheet and the paper brace were placed in a transparent polymer pouch that was previously sealed on three sides. The dimensions of the imaged polyester sheet and the paper were slightly less than that of the polymer pouch such that the open edge could be heat sealed and trimmed to form an enclosed mechanically assembled picture. The polymer pouch used was a vinyl pouch that was previously heat and mechanically crimped sealed on three sides. The assembled picture image and paper brace were placed through the open edge of the pouch and the air remove using a vacuum assist and the top and bottom side of the vinyl pouch were then brought together and under pressure and heat the edges were fused together and trimmed to form a mechanically assembled picture.

Example 4

This example was the same as Example 3 except that the paper brace was replaced with a blue tinted biaxially oriented sheet of polypropylene. The brace portion of this example is shown below:

| | |
|---|---|
| L1 | 0.75 $\mu$m Clear Medium Density Polyethylene w tint colorants |
| L2 | 7 $\mu$m Polypropylene with 24% Rutile $TiO_2$ |
| L3 | 20.3 $\mu$m voided polypropylene w PBT voiding agent |
| L4 | 7 $\mu$m Polypropylene with 18% Rutile $TiO_2$ |
| L5 | 1.2 $\mu$m Clear Polypropylene Layer |
| L6 | 12.5 $\mu$m 10 Melt Index polyethylene |
| L7 | 17.4 $\mu$m Mobil Bicor 70MLT (matte layer) |

The brace in this example was prepared by extrusion laminating a 5 layer biaxially oriented sheet with a biaxially oriented sheet with a matte copolymer layer using a 10 melt index polyethylene that was melted to 610° F. and extruded between the two sheets to adhere them together.

Example 5

The mechanically assembled picture of this invention was prepared the same as Example 3 except that the paper brace was replaced with a voided polyester sheet. The sheet used as a brace was:

| | |
|---|---|
| L1 | 8 $\mu$m Layer of 40% Rutile Dupont R-104 $TiO_2$ in Polyester |
| L2 | 75 $\mu$m Layer of Voided Polyester |

The brace in this example was coextruded and biaxially oriented. The voided polyester sheet was prepared using a limited coalescence as described in the detailed section of this disclosure. The L1 layer was this brace was prepared by compounding rutile $TiO_2$ into the polyester polymer and coextruding it with the voided layer.

The invention has been described in detail with particular reference to certain preferred embodiments thereof, but it will be understood that variations and modifications can be effected within the spirit and scope of the invention.

What is claimed is:

1. A mechanically assembled picture comprising at least one image element comprising an image on a thin polymer sheet, a brace, and a transparent polymer sheet overlaying said image and brace, wherein said transparent sheet mechanically holds said image to said brace.

2. The mechanically assembled picture of claim 1 wherein said transparent sheet comprises a polymer sheet that overlays said image and the edges of said brace and image has been shrunk to mechanically hold said image to said brace.

3. The mechanically assembled picture of claim 1 wherein said transparent sheet comprises a polymer sheet bag that is sealed to mechanically hold said image to said brace.

4. The mechanically assembled picture of claim 3 wherein said bag has a vacuum applied prior to sealing.

5. The mechanically assembled picture of claim 2 wherein said transparent sheet is a bag that is sealed and shrunk after drawing a vacuum.

6. The mechanically assembled picture of claim 1 wherein said transparent sheet comprises an oxygen barrier layer having an oxygen transmission rate of less than 8.0 cc/m$^2$·hr. atm.

7. The mechanically assembled picture of claim 1 wherein said transparent sheet comprises a water vapor barrier layer having a water vapor transmission rate of less than $0.85\times10^{-5}$ g/mm$^2$/day.

8. The mechanically assembled picture of claim 1 wherein said transparent sheet comprises a shrunk polyolefin sheet.

9. The mechanically assembled picture of claim 1 wherein said transparent sheet comprises a shrunk polyester sheet.

10. The mechanically assembled picture of claim 1 wherein said transparent sheet comprises a shrunk polyamide sheet.

11. The mechanically assembled picture of claim 1 wherein said transparent sheet comprises ultraviolet absorber.

12. The mechanically assembled picture of claim 1 wherein said transparent sheet has a modulus of at least 400 MPa.

13. The mechanically assembled picture of claim 1 wherein said brace is substantially opaque.

14. The mechanically assembled picture of claim 1 wherein said brace has a white surface in contact with said image element.

15. The mechanically assembled picture of claim 1 wherein said brace is transparent.

16. The mechanically assembled picture of claim 1 wherein said brace has a stiffness of 150 Newtons.

17. The mechanically assembled picture of claim 1 wherein said picture has a stiffness of greater than 150 millinewtons.

18. The mechanically assembled picture of claim 1 wherein said brace comprises a fragrance.

19. The mechanically assembled picture of claim 1 wherein said brace comprises a desiccant.

20. The mechanically assembled picture of claim 1 wherein said brace comprises cellulose fiber.

21. The mechanically assembled picture of claim 1 wherein said brace comprises a voided polymer sheet.

22. The mechanically assembled picture of claim 1 wherein said brace is nonplanar.

23. The mechanically assembled picture of claim 1 wherein said brace is curved.

24. The mechanically assembled picture of claim 1 further comprising an image in contact with each side of said brace.

25. The mechanically assembled picture of claim 3 wherein said bag further comprises a roughness of at least 0.3 micrometers at a spatial frequency of at least 5 micrometer or greater.

26. The mechanically assembled picture of claim 3 wherein said bag further comprises a tab with holes.

* * * * *